US007134651B1

(12) United States Patent
Beck

(10) Patent No.: US 7,134,651 B1
(45) Date of Patent: Nov. 14, 2006

(54) J-CLAMP FOR WOODWORK AND METHOD OF USE

(76) Inventor: James W. Beck, P.O. Box 1008, Chino Valley, AZ (US) 86323

( * ) Notice: Subject to any disclaimer, the term of this patent is extended or adjusted under 35 U.S.C. 154(b) by 4 days.

(21) Appl. No.: 11/243,070

(22) Filed: Oct. 3, 2005

(51) Int. Cl.
*B25B 1/02* (2006.01)

(52) U.S. Cl. ..... 269/147; 269/16

(58) Field of Classification Search ..... 269/147, 269/166, 167, 197, 204, 165, 252, 902
See application file for complete search history.

(56) References Cited

U.S. PATENT DOCUMENTS

| | | | | |
|---|---|---|---|---|
| 641,694 | A | 1/1900 | Hamelehle | |
| 1,608,320 | A | 11/1926 | Karseboom | |
| 2,174,947 | A | 10/1939 | Ramsey | |
| 2,203,162 | A | 6/1940 | Lee | |
| 2,773,406 | A | 12/1956 | Dachauer | |
| 3,499,206 | A * | 3/1970 | Quernheim | 29/239 |
| 3,596,898 | A | 8/1971 | Hilburn | |
| 3,675,916 | A | 7/1972 | Kartasuk et al. | |
| 3,877,624 | A | 4/1975 | Carson | |
| 4,305,575 | A | 12/1981 | Bardes | |
| 4,363,475 | A | 12/1982 | McCarty | |
| 4,437,654 | A | 3/1984 | Chiappetti | |
| 4,747,588 | A | 5/1988 | Dillhoff | |
| 4,880,221 | A | 11/1989 | Richards | |
| 4,921,234 | A | 5/1990 | Peterson | |
| 5,002,264 | A | 3/1991 | Nimtz | |
| 5,064,178 | A | 11/1991 | Nimtz | |
| 5,135,209 | A | 8/1992 | Penny | |
| 6,039,313 | A * | 3/2000 | Baculy | 269/168 |
| 6,311,589 | B1 | 11/2001 | Schmitt | |
| D500,238 | S | 12/2004 | Varzino | |
| 6,935,628 | B1 * | 8/2005 | Conversa | 269/147 |

* cited by examiner

*Primary Examiner*—Lee D. Wilson
(74) *Attorney, Agent, or Firm*—Schmeiser, Olsen & Watts LLP

(57) ABSTRACT

An angled clamp is capable of holding one wall at an obtuse angle relative to another wall. Alternatively, a conventional clamp may be modified with a clamp attachment having a jaw engaging piece and an opposite clamping surface with at least two flat portions forming a channel for receiving a work piece, in which the channel extends in a first transverse direction relative to a clamping direction. The attachment may have an attachment mechanism configured to be installed on a jaw of the conventional clamp by sliding in a second transverse direction relative to the direction of clamping. Alternatively, the attachment mechanism may include a ring for holding the attachment mechanism on the jaw. A method may include bonding first and second walls together at an obtuse angle without requiring the use of other fasteners.

19 Claims, 5 Drawing Sheets

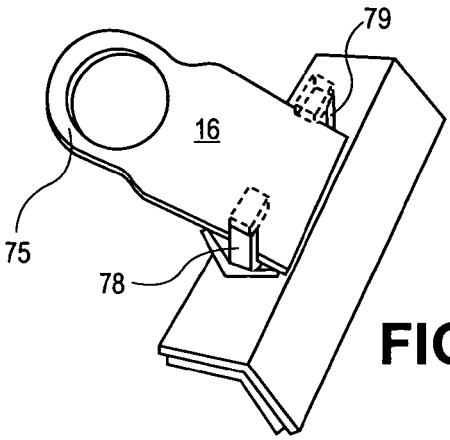
FIG. 3
FIG. 4
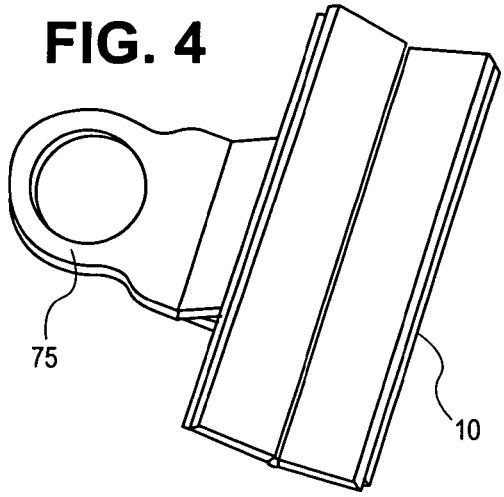
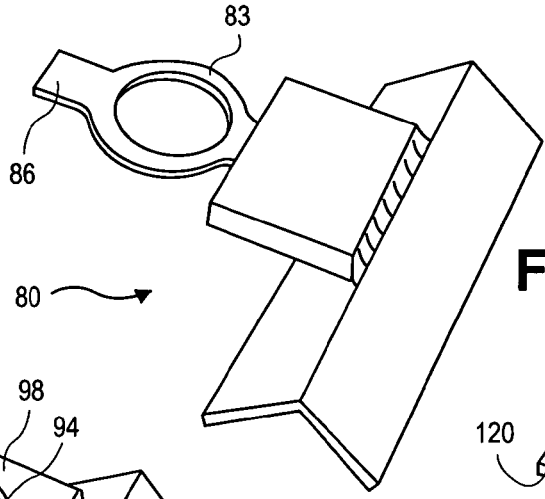
FIG. 5A
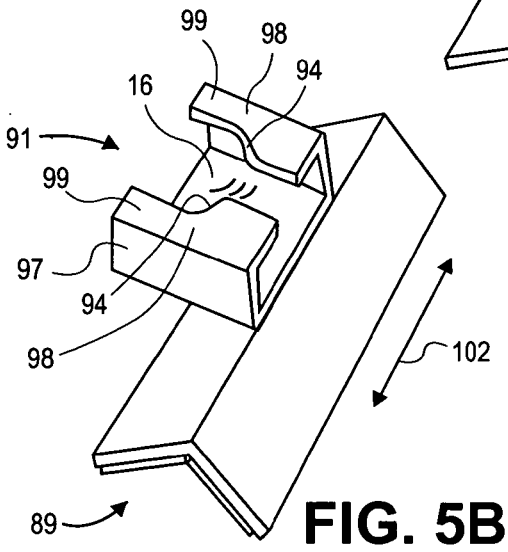
FIG. 5B
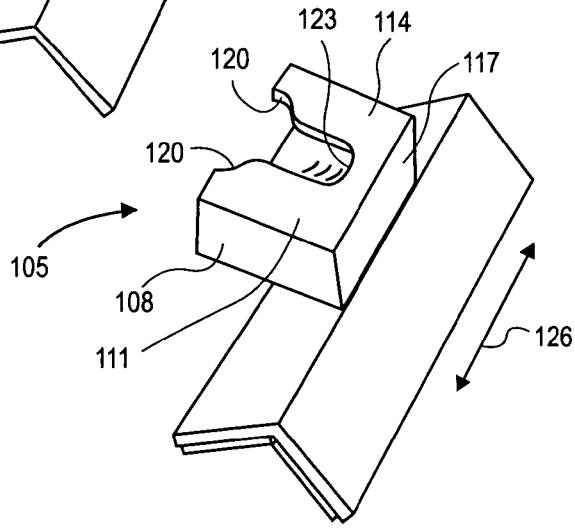
FIG. 5C

J-CLAMP FOR WOODWORK AND METHOD OF USE

BACKGROUND OF THE INVENTION

1. Technical Field

The technical field of the invention relates generally to clamps and more specifically to clamps for clamping walls together at obtuse angles.

2. Background Art

In the past, cabinetmakers have generally secured adjacent walls of cabinets that intersect at an angle by relying upon use of screws or nails that extend through elongate holes into both walls of a cabinet. This approach leaves elongate holes that are then typically filled with a putty or other filling material. The filling material almost never matches, and the hole and/or filler thus interrupts and mars the beauty of the wood grain of a subject frame and/or an overall cabinet. The present invention offers a solution that obviates the need for using screws. With the present invention, the walls can be glued and held in place without the use of screws or holes. The invention may includes an angled clamp for a woodworking clamp that can hold one wall at an angle to another, allowing glue to dry without the creation of holes in the wood, or allowing the walls to be secured at an angle while being welded or fused together.

DISCLOSURE OF THE INVENTION

The present invention offers a solution that obviates the need for using screws or nails and the associated holes in a cabinet surface. With the present invention, the walls can be glued and held in place without the use of screws or holes. To this end, the invention may include an angled clamp that can hold one wall at an angle relative to another wall. The invention may also include a step of allowing glue to dry without the creation of holes in the wood, or a step of allowing the walls to be secured at an angle while being welded or fused together.

The invention may include a clamp attachment with a jaw engaging piece. The jaw engaging piece may have a jaw engaging surface generally defining a plane. The clamp attachment may have a first clamping surface facing in a clamping direction opposite the jaw engaging surface. The first clamping surface may include at least two flat portions forming a channel. The line(s) of intersection between the flat portions of the first clamping surface may generally define at least a first line of intersection that extends in a first direction transverse to the clamping direction. The clamp attachment may further include an attachment mechanism attached to the jaw engaging surface. The attachment mechanism may include an end wall forming a positive stop for inhibiting movement of the clamp attachment in a second retaining direction. The second retaining direction may be transverse to each of the first direction and to the clamping direction.

The bar clamp attachment may include a removable clamp attachment including a base plate including a jaw engaging surface; and a jaw-receiving channel on the jaw engaging surface. The jaw receiving channel may have a depth and shape to receive a clamp jaw. The jaw-receiving channel may include the end wall, as described above, and at least a side wall forming a positive stop against movement in at least a third retaining direction. The third retaining direction may be parallel to the line of intersection that extends in the first direction.

The invention may further include a ring. The ring may lie in a same plane as the jaw engaging surface. The plane of the ring may extend transverse relative to the clamping direction. The end wall, in this case, may be provided by a portion of an inner surface of the ring. The first clamping surface may be centered at a greater distance from the bar clamp bar than a center of at least one of the other bar clamp jaws.

The bar clamp attachment may be molded or cast as a single integral piece. The bar clamp attachment may be a first bar clamp attachment of a plurality of similar bar clamp attachments so that a kit may include one or more bar clamp attachments and may also include a bar clamp.

The invention may include a bar clamp having a bar supporting at least two jaw pieces. At least a first of the jaw pieces may have a first clamping surface facing in a direction parallel to a longitudinal axis of the bar clamp bar. At least a second of the jaw pieces may have a second clamping surface facing in a direction opposite of the direction faced by the first clamping surface. The first clamping surface may include at least a first planar portion and a second planar portion forming a channel. The first clamping surface may include at least a first line of intersection between the at least first and second planar portions of the first clamping surface. The at least first line of intersection may not lie in the same plane as the longitudinal axis of the bar clamp bar. The first clamping surface may be centered at a greater distance from the bar clamp bar than from a center of another clamping surface of the bar clamp.

The first clamping surface may further include a third planar portion. A second line of intersection between the second and third planar portions of the clamping surface may lie in the same plane as the first line of intersection. The planar portions of at least the first clamping surface may intersect at right angles to each other.

The planar portions of at least the first clamping surface may intersect each other forming an angle less than one hundred eighty degrees. The first clamping surface may be positioned at a predetermined angle by an angled gusset fused to both the clamp jaw and the channel. The invention may further provide that the flat portions of the clamping surface(s) are covered or coated with a non-abrasive material, such as felt, rubber, leather, and/or other material.

The at least one clamp jaw may be molded or cast as a single integral piece. The at least first clamping surface may include a U-shaped channel configured for receiving a first wall oriented at an obtuse angle relative to an adjacent second wall to which the first wall is being attached. The at least first clamping surface may include a L-shaped channel configured for receiving a first wall oriented at an obtuse angle relative to an adjacent second wall to which the first wall is to be attached.

The invention may include a method of securing a first wall to a second wall at an obtuse angle including the following steps: abutting the walls against to each other at an obtuse angle by engaging a first bonding edge of the first wall to a first bonding edge of the second wall; engaging a second clamping edge of the first wall with a first angled jaw of the bar clamp; engaging a second clamping edge of the second wall with a second jaw of the bar clamp; and tightening the clamp to induce a snug fit between the first and second walls.

The method of securing may further include preliminarily applying an adhesive to each of the first edges of the first and second walls. The method may include engaging the first edges of the first and second walls with the first and second walls extending at a predetermined obtuse angle. The method may further include using a hand mallet or other object to adjust the walls to a flush fit. Subsequent steps may include further tightening the clamp and allowing a glue, adhesive, or other bonding mechanism to set up or bond the walls while they are held in place by the clamp.

The invention may further include bonding the first wall to the second wall at an obtuse angle. The bonding may be accomplished by welding, fusing, riveting, gluing and/or other manners of attaching two or more pieces of an end structure together.

BRIEF DESCRIPTION OF THE DRAWINGS

FIG. 3 is a perspective end view showing a jaw engaging surface of the clamp attachment in accordance with the first embodiment with the clamp attachment unattached relative to the bar clamp;

FIG. 4 is a perspective end view showing a clamping surface of the clamp attachment in accordance with the first embodiment with the clamp attachment with the clamp attachment unattached relative to the bar clamp;

FIGS. 5A–5C are perspective end views showing respective jaw engaging surfaces of respective alternative embodiments of clamp attachments;

DETAILED DESCRIPTION OF EMBODIMENTS OF THE INVENTION

The present invention relates generally to clamps and more specifically to clamps for clamping walls together at obtuse angles. Thus, embodiments of the present invention relate to J-clamps and methods of using the J-clamps.

Figure 1A:
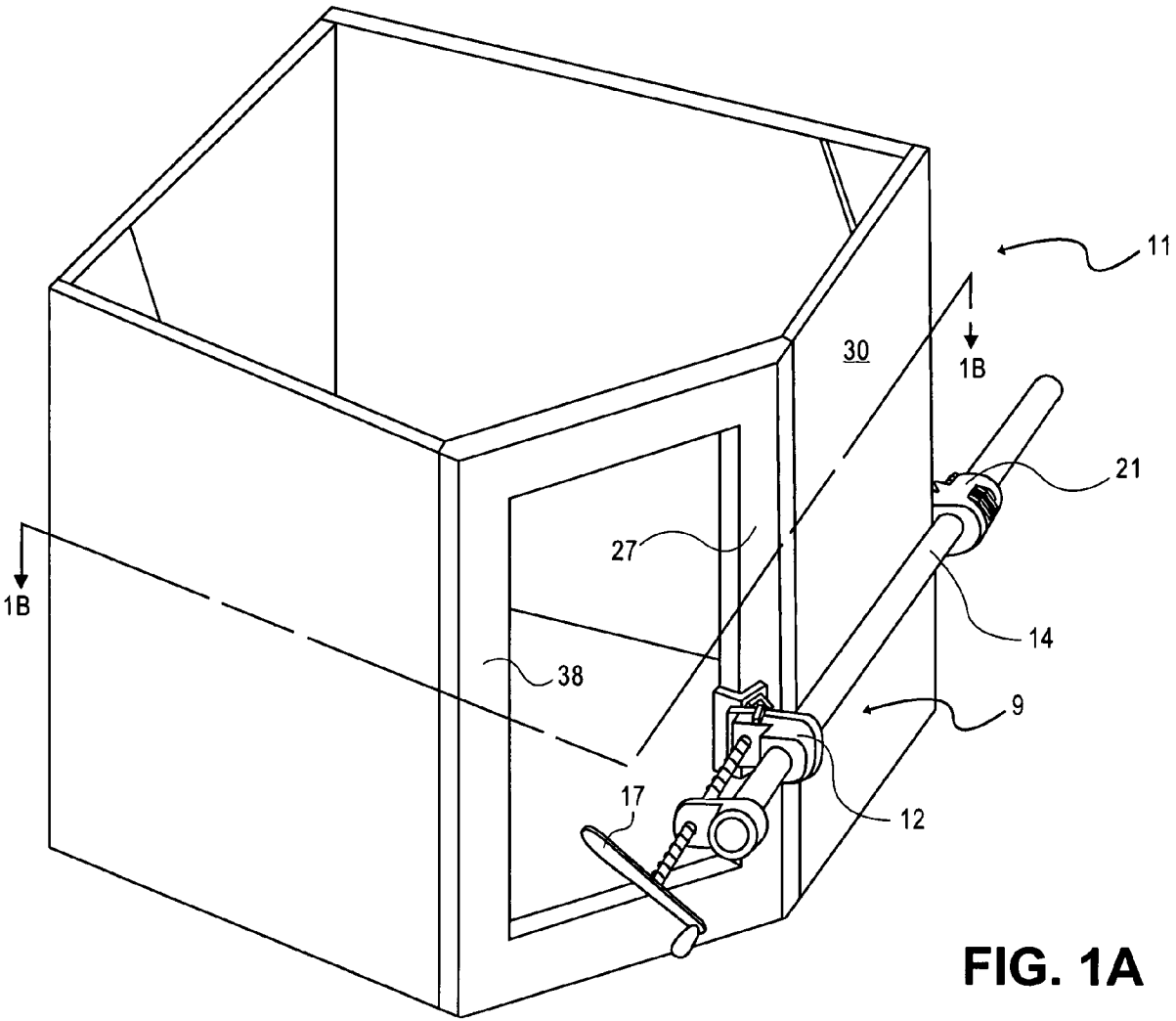
FIG. 1A is an exemplary perspective view of a first embodiment of a clamp attachment in use on a clamp engaged in clamping relation abuttingly adjoining two walls of an overall cabinet.

As shown in the exemplary perspective view of FIG. 1A, a J-clamp 9 is engaged on an overall cabinet 11 in an abuttingly adjoining relationship with two adjacent walls of the cabinet 11. As may be appreciated, the cabinet 11 may be a corner cabinet with a diagonally oriented face frame for receiving a door or the like, as shown in the exemplary illustration of FIG. 1A. On the other hand, it is to be understood that the J-clamps of the present invention may be applied to any two adjacent walls that are to be joined together at an obtuse angle in a clamping operation.

Figure 1B:
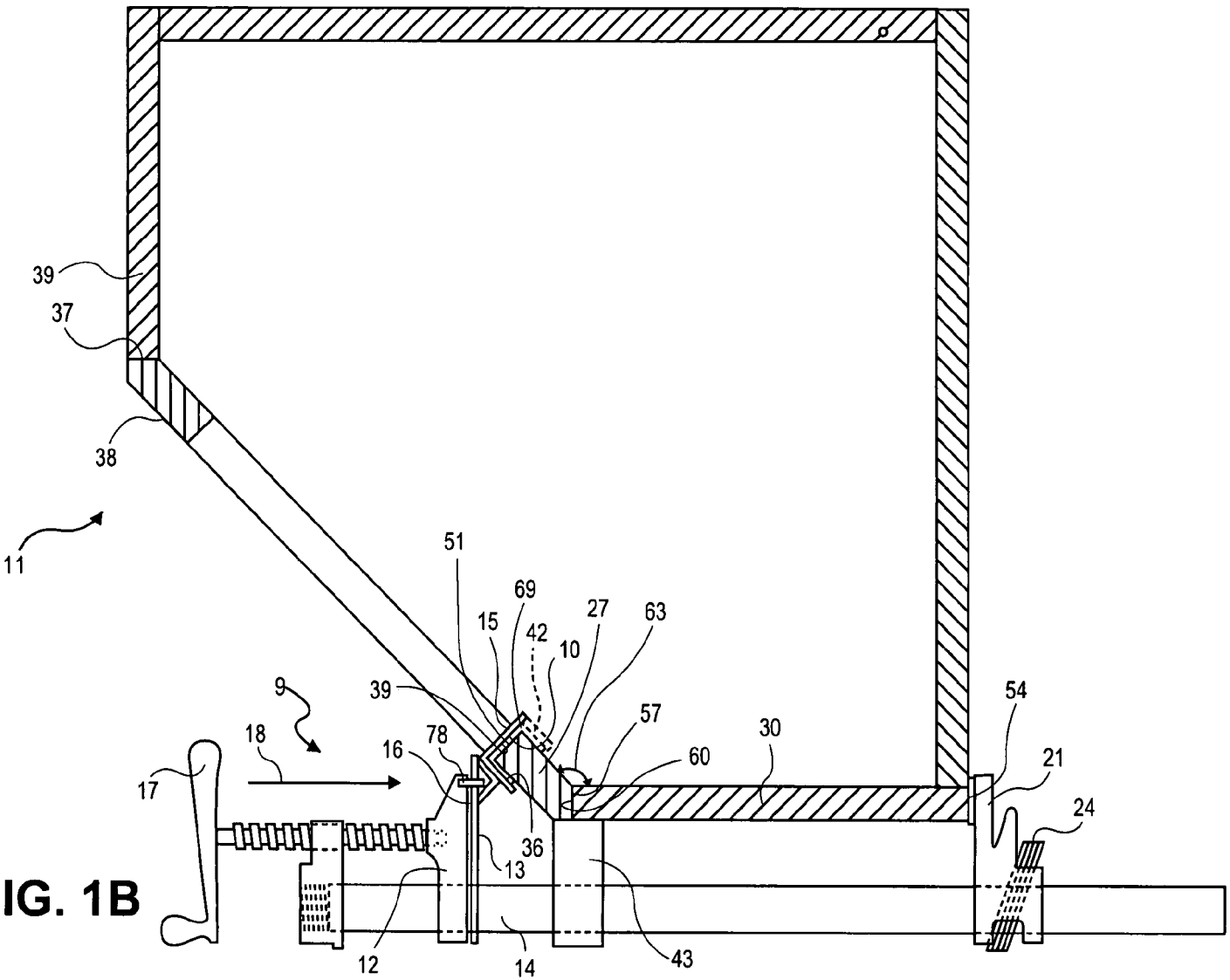
FIG. 1B is a sectional view taken along lines 1B—1B of FIG. 1A showing the clamp attachment in accordance with the present invention in which the clamp and attachments are used to secure the two adjacent walls of the overall cabinet together at an obtuse angle.

FIG. 1B is a sectional view taken along lines 1B—1B of FIG. 1A showing the J-clamp of the present invention in use on the overall cabinet 11. As with C-clamps or F-clamps, a J-clamp 9 configured according to the present invention may generally have a "J" shape, as shown in FIG. 1B. The "J" shape may be formed at least in part by a clamping surface 10 that is formed by a first clamp jaw 12 or a clamp attachment 13 supported on the first clamp jaw 12 in which the clamping surface 10 extends at an angle other than a perpendicular angle from a bar 14 of a bar clamp. Thus, at least a portion of the clamping surface 10 forms a tail 15 that resembles a tail of a "J". It is to be understood that in the embodiments that incorporate a clamp attachment similar to attachment 13, the clamp attachment may be a jaw engaging piece with a jaw engaging surface 16. The clamp attachment 13 may also include the at least one clamping surface 10 for engaging a work piece at an angle other than parallel to a clamping direction 18.

The several embodiments of the present invention are readily adaptable to a variety of woodworking or other bar clamps. According to the first embodiment, a clamp attachment 13 may be or include a jaw engaging piece having a jaw engaging surface 16. The jaw engaging surface 16 may be planar. The clamp attachment 13 of the present invention is shown attached to a woodworking clamp with the jaw engaging surface 16 abutting a first clamp jaw 12 of the woodworking clamp in such a manner that the first jaw 12 applies pressure toward the jaw engaging surface 16 in response to the clamp 9 being tightened.

In use, the clamp 9 may be tightened by turning a clamp handle 17 clockwise. As the clamp 9 is tightened, the first jaw 12 moves in a clamping direction 18. The clamping direction 18 is generally the direction toward a second clamp jaw 21, and is parallel to a longitudinal axis of the bar 14. The second jaw 21 may be adjustably placed along the bar 14 by releasing a spring biased gripping element 24 and sliding the second jaw 21 along the bar 14. Once in a desired position, the spring biased gripping element 24 may be released to lockingly engage the bar 14. Thus, the second jaw 21 will remain fixed to the bar 14 in a desired position so that the clamp 9 that is being tightened does not cause the second jaw to move relative to the bar 14.

The first jaw 12 may apply a clamping force via the jaw engaging surface 16 in the clamping direction 18. A resulting force is applied to a work piece 27 through the clamping surface 10, which faces in the same general direction as the clamping direction 18. A clamping force is thus applied to the work piece 27 through the clamping surface 10. In the first embodiment of the present invention, the clamping surface 10 may include at least two planar portions 36, 39 forming a wall or work piece receiving channel. In the first embodiment of the present invention, the first planar portion 36 and the second planar portion 39 of the clamping surface 10 intersect at an angle less than one hundred eighty degrees. In fact, as shown, the first and second planar portions 36, 39 may form an "L" shaped wall-receiving channel 45. In other embodiments of the present invention, the clamping surface 10 may include three planar portions including the first planar portion 36, the second planar portion 39, and a third planar portion forming a generally "U" shaped channel to be described in greater detail below.

The planar portions 36 and 39 of the clamping surface 10 may intersect at an angle less than one hundred eighty degrees to engage at least one end edge of a work piece and an adjacent side of the work piece simultaneously. As may be appreciated, the second jaw 21 exerts a force on a second work piece 30 in a direction opposite to the arrow 18 in a clamping direction during clamping. However, as shown, the force applied by the second clamp 21 is generally at a position closer to the bar 14 than is the force applied by the clamping surface 10. Furthermore, work pieces 27 and 30 are generally not rigidly connected to each other when the clamping forces are applied. Therefore, there must be a mechanism to overcome a resulting torsional force that would otherwise cause the work pieces 27 and 30 to buckle relative to each other. When the present invention is applied to an overall cabinet 11, a reactive torsional force is readily provided by the other structure of the overall cabinet 11, such as by a reactive force at an opposite end edge 37 of a face frame 38 of which the work piece 27 is an integral part. As shown, the end edge 37 abuts another wall 39 of the overall cabinet 11 so that buckling of the first and second work pieces 27, 30 is not possible.

On the other hand, if the present invention is applied to two work pieces by themselves other mechanisms may be incorporated to prevent buckling of the first and second work piece. For example, the clamping surface may include an additional planar portion 42 that may intersect with the second planar portion 39 to form a generally "U" shaped channel. As may be appreciated, even without other cabinet structure, such a "U" shaped channel will be capable of exerting a reactive torque, which in the exemplary embodiment of FIG. 1 would apply a reactive torque to the first work piece 27 in a counterclockwise direction as viewed. While the three planar portions 36, 39, and 42 are shown at generally right angles relative to each other, it is to be understood that the planar portions 36, 39 and 42 that provide the clamping surface 10 may intersect each other at any of a variety of angles less than one hundred eighty degrees.

Additionally or alternatively, an abutting element 43 may be adjustably disposed on the bar 14. The abutting element 43 may thus be slid along the bar to a position in which it engages the first and/or second work piece 27, 30. As shown, the abutting element would abut the second work piece 27 and prevent clockwise movement and buckling of the first work piece 27 relative to the second work piece 30 during clamping.

A more general purpose of the "L" or "U" shaped wall-receiving channels is to receive a second clamping edge 51 of the first wall or work piece 27 that is to be attached to a second wall or work piece 30 of an overall cabinet 11, for example. The second wall or work piece 30 may include a second clamping edge 54. The first and second walls 27, 30 may also include respective first bonding edges 57, 60. Each of the clamping edges 51, 54 are on the opposite ends of the respective walls 27, 30 relative to the bonding edges 57, 60. The second clamping edge 54 of the second wall 30 may be purely axially engaged by the second clamp jaw 21, while the second clamping edge of the first wall 27 may be cradled by the clamping surface 10 for both an axial and a radial engagement relative to a clamping direction and the bar axis. As shown, the first wall 27 and the second wall 30 may intersect at an obtuse angle 63 which may be from ninety to one hundred eighty degrees. Alternatively, the obtuse angle may be any angle in a range from one hundred twenty to one hundred fifty degrees. Further alternatively, the obtuse angle may be approximately one hundred thirty-five degrees. The range of angles may be alternatively described in terms of the anile of one of the planar portions 36, 39 relative to the clamping direction 18, or in terms of the angle of one of the planar portions 36, 39 relative to a plane of the clamp engaging surface 16, as may be appreciated from the illustrations of FIGS. 1B and 2. These angles are directly related to the angles described above with retard to the work pieces 27, 30 such that the range may be expressed as being in a range from zero to ninety degrees. For example, the angle of one of the planar portions 36, 39 relative to either the clamping direction 18 or the plane of the clamp engaging surface 16 may be from approximately five degrees to approximately eighty-five degrees or other selected angles within the range from zero to ninety degrees.

The first planar portion 36 may lie normal to the second planar portion 39. Similarly, the third planar portion 42 may lie parallel to the first planar portion 36. In alternate embodiments of the present invention, the first and third planar portions 36, 42 may be oriented in relation to the second planar portion 39 at any angle less than or equal to one hundred eighty degrees. A wall receiving channel formed by the clamping surface 10 may be selectively placed at any of a variety of angles 66 relative to the clamping direction 18 and resulting in the clamping of the first and second walls or work pieces 27, 30 at corresponding angles within the ranges set forth above. That is, the angle between the wall receiving channel and the clamping direction 18 may determine the angle 63 of the adjoined walls 27, 30. In the first embodiment of the present invention shown in FIGS. 1 and 2, the angle 66 between the wall-receiving channel 45 and the clamping direction 18 is one hundred and thirty-five degrees. Alternate embodiments of the present invention provide that the angle 66 between the wall-receiving channel 45, 48 and the clamping direction 18 is any angle less than or equal to one hundred eighty degrees and greater than or equal to ninety degrees, so that the alternate embodiments can clamp adjacent walls at angles from ninety to one hundred eighty degrees. Alternate embodiments may include an adjustable wall-receiving channel wherein the angle between the wall-receiving channel and the clamping direction may be adjusted to any angle from ninety to one hundred eighty degrees, thus allowing the user to vary the angle of the adjacent walls to be bonded together.

The size of the planar portions 36, 39, 42 of the clamping surface 10 may be large enough that the clamping surface 10 can apply force to the objects being clamped 27, 30, but small enough that it is not unwieldy to use. For example, an extended dimension of the first portion 36 may aid in preventing buckling of the first work piece 27 relative to the second work piece 30 during clamping. In the various embodiments of the present invention, the planar portions 36, 39, 42 may be coated or covered with a thin non-abrasive layer 69 made of rubber or other material to protect the clamped work piece 27 from being scratched. For example and not by way of limitation, the clamping surface may be coated with felt, leather, rubber and/or other materials.

Figure 2:
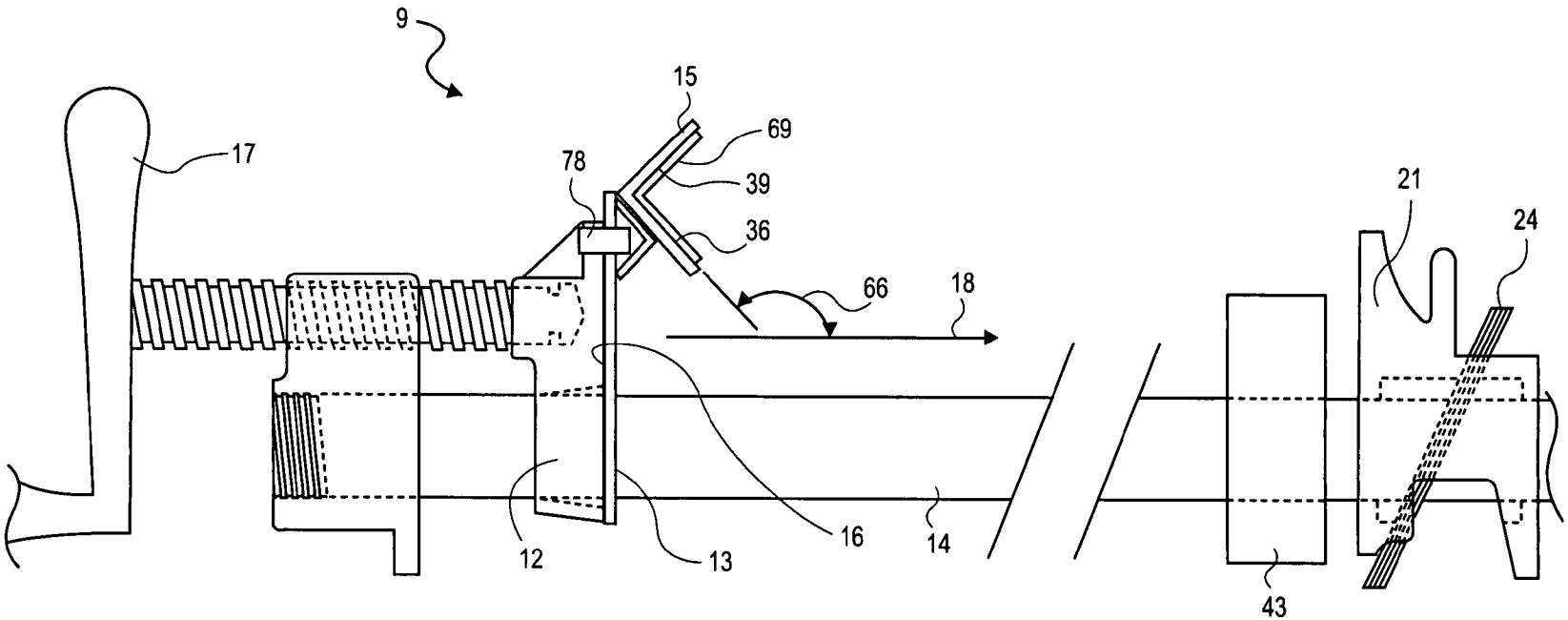
FIG. 2 is another top view of the first embodiment of the clamp attachment supported on a woodworking clamp.

In embodiments of the present invention that include a clamp attachment, the clamp attachment may further include an attachment mechanism. In the embodiment of FIGS. 1 and 2, the attachment mechanism may include a ring 75 as shown in FIGS. 3 and 4. FIG. 3 is an end view showing a jaw engaging surface of the clamp attachment 13 in accordance with the first embodiment with the clamp attachment unattached relative to the bar clamp. The ring 75 encircles the bar 14 and maintains the lateral position of the clamp attachment 13 relative to the bar 14 as viewed in FIGS. 1 and 2. The size of the ring 75 is slightly larger than the bar 14, so that it is able to slide along the bar 14, but not so large that the attachment can move about laterally in relation to the bar 14. The ring 75 allows the attachment to move longitudinally along the bar 14, and to rotate about the bar 14 when the bar 14 has a round section. The ring 75 may lie generally in the same plane as the jaw engaging surface 16. The ring may be formed together with a portion of the clamp attachment forming the jaw engagement surface 16. In alternate embodiments of the present invention, the ring may be of a size and shape to fit over the bar clamp bar and restrict lateral and rotational movement. For example, if a bar has a square-shaped cross section, the ring may have a complimentary square shape.

The clamp attachment 13 in accordance with the first embodiment of the present invention may include two retaining fingers 78, 79 to prevent the bar clamp attachment from rotating around the bar 14 when the attachment is abutted against the first clamp jaw 12. The retaining fingers 78, 79 may protrude from the edges of the jaw engaging surface 16 in a direction opposite the clamping direction 18 with the clamp attachment in an attached state. The retaining fingers 78, 79 may be placed on opposite side edges of the jaw engaging surface 16, and may abut the first clamp jaw 12 on either or both sides of the first jaw 12. Thus, the fingers 78, 79 may restrict radial movement of the attachment 13 in relation to the bar 14. Alternate embodiments of the present invention may include additional fingers or extensions of fingers 78, 79 to engage the first clamp 12 and prevent the bar clamp attachment 13 from inadvertently moving out of engagement with the first clamp jaw 12.

FIG. 4 is an end view of the clamp attachment 13 showing a clamping surface of the clamp attachment 13 forming a channel in accordance with the first embodiment of FIGS. 1–3 with the clamp attachment unattached relative to the bar clamp.

FIGS. 5A–5C show perspective end views similar to FIG. 3 of a variety of clamp attachments that vary primarily with regard to their respective attachment mechanisms. A clamp attachment 80 of FIG. 5A is similar to the clamp attachment of FIGS. 1–4. The clamp attachment 80 has an attachment mechanism that includes a ring 83, and additionally includes a tab 86 to aid in moving the clamp attachment 80 along the bar 14. However, the clamp attachment 80 does not include retaining fingers as does clamp attachment 13. Therefore, the clamp attachment 80 will not be inhibited against rotational movement relative to the bar 14.

FIG. 5B is a perspective view of a clamp attachment 89 with an attachment mechanism that includes a jaw-receiving channel 91 formed on the jaw engaging surface 16. The jaw-receiving channel 91 may include one or more retaining walls 94 to inhibit the clamp attachment 89 from sliding laterally toward the bar 14 and first clamp jaw 12 as viewed in FIG. 1. The lateral direction may be alternatively defined by directions along a line between a center of the bar 14 and a center of the jaw engaging surface 16, and lying in the same plane as the jaw engaging surface 16. As shown, the attachment mechanism of the clamp attachment 89 may include one or more upstanding wall 97 and one or more overlying wall 98 that form one or more respective bracket. At least one of the upstanding walls 97 and the overlying walls 98 abuttingly engage a clamp jaw received therein and inhibit movement of the clamp attachment 89 in one or both of retaining stopping directions indicated by double headed arrow 102. Thus, the retaining wall 94 may provide for a positive stop to the clamp attachment 89 in the retaining stopping direction toward the bar 14, and the upstanding and/or overlying walls may provide a positive stop in one or both retaining stopping directions that may be generally parallel with a line of intersection between the planar portions 36, 39 of the clamping surface.

The width of the jaw-receiving channel 91 may be slightly greater than the width of a clamp jaw to be received therein. The clamp jaw 12 may be inserted into the jaw-receiving channel 91 prior to engaging the first wall 27 with the clamping surface 10. As a response to tightening the clamp, the first clamp jaw 12 may apply a clamping force normal to the jaw engaging surface 16. This force may thus create increased friction between the clamp jaw 12 and the jaw engaging surface 16, thus preventing the clamp attachment 13 from sliding in a direction away from the bar 14 and off the clamp jaw 12.

FIG. 5C is a perspective view of a clamp attachment 105 having an upstanding wall 108 and an overlying wall 111 analogous to the upstanding walls and overlying walls of FIG. 5B. However, the upstanding wall 108 and overlying wall 111 of the clamp attachment 105 of FIG. 5C forms a pocket type bracket 114. The pocket type bracket has an end wall 117 that may be formed by a portion of the upstanding wall 108 and that may inhibit and/or positively stop movement of the clamp attachment 105 toward the bar 14 by itself or together with retaining walls 120, 123 similar to the embodiment of FIG. 5B. The upstanding wall 108 and/or overlying wall 111 may inhibit movement in the retaining stopping directions indicated by double headed arrow 126 similar to that described with regard to the embodiment of FIG. 5B.

Figure 7:
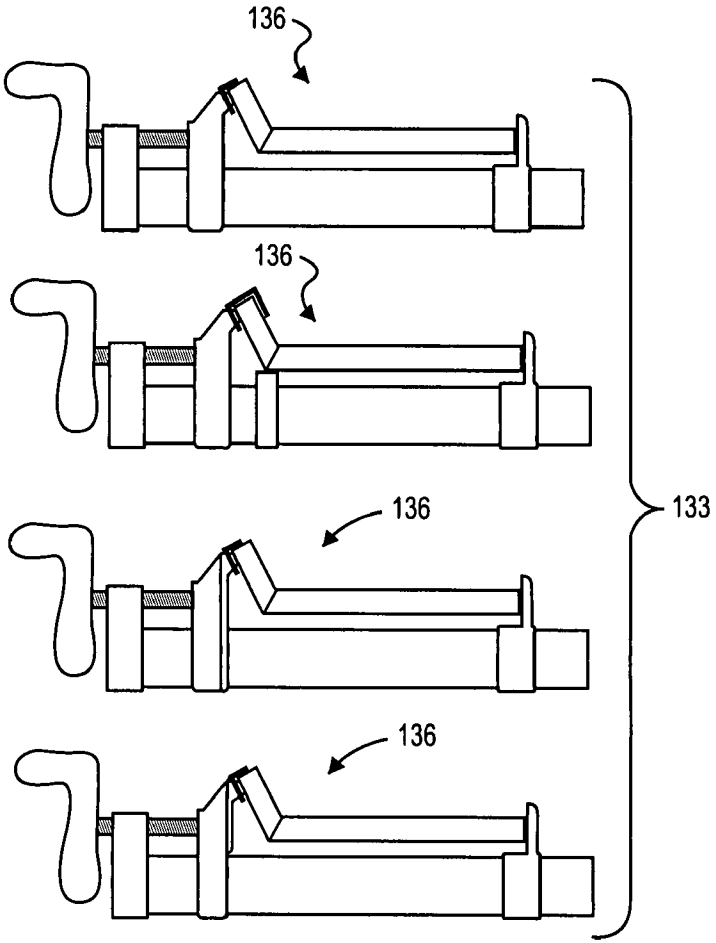
FIG. 7 is a perspective view of a plurality of bar clamps having bar clamp jaws and/or clamp attachments in accordance with the present invention.
Figure 6:
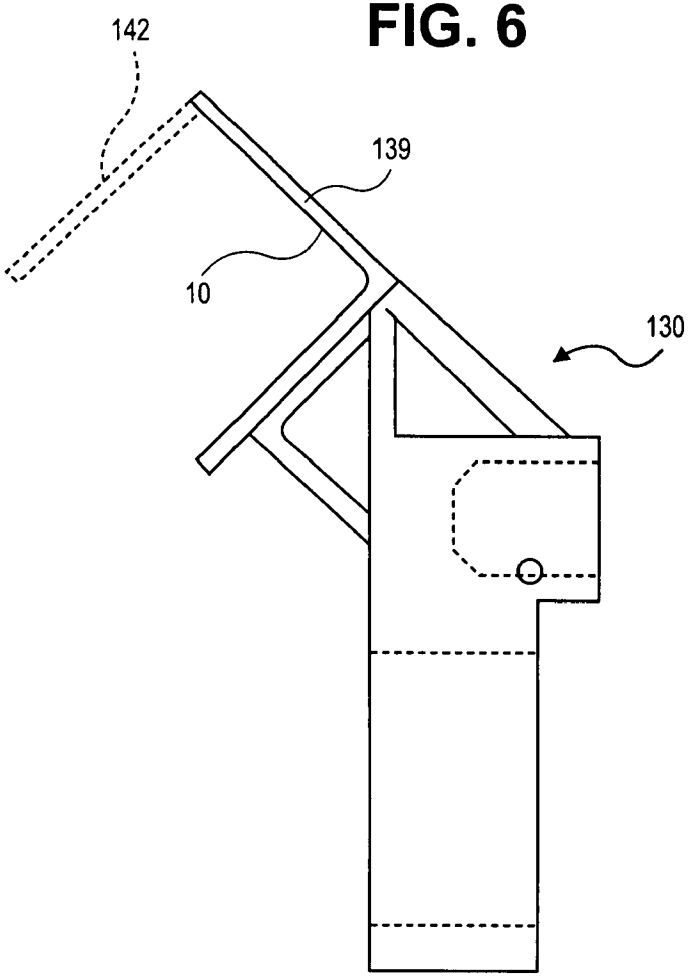
FIG. 6 is bottom view of a bar clamp jaw of a bar clamp in accordance with another embodiment of the present invention.

FIG. 6 is a bottom view of a bar clamp jaw 130 of a bar clamp in accordance with another embodiment of the present invention. That is, the present invention may include one or more bar clamps 133 that have the angled clamping surface integrated on the clamp jaw 130 itself, as shown in FIG. 7. A bar clamp 136 such as those shown in FIG. 9 may further include a first jaw 130 and a second jaw 21 similar to that shown in FIGS. 1 and 2. Alternatively, the clamps of FIG. 7 may incorporate the clamp attachments of FIGS. 1–5C. The bar clamp 136 may include a clamp handle 17, which when rotated, causes the first jaw 12, 130 to move toward the second jaw 21 in a clamping direction 18. Alternate embodiments may include other mechanisms for causing the first jaw to move in the clamping direction. The first jaw 12, 130 may include a clamping surface 10 facing in the clamping direction, as described above. The clamping surface 10 may include a wall receiving "L" shaped channel 139 forming the clamping surface 10, or may include a wall-receiving "U" shaped channel 142 as has been described above. The "U" shaped channel 142 may be oriented at an angle 66 ranging from ninety to one hundred eighty degrees in relation to the clamping direction 18 as shown and described with regard to FIGS. 1 and 2.

FIG. 7 shows a set of bar clamps 133 in accordance with the present invention. The set of bar clamps 133 may include one or more bar clamp 136 and/or one or more bar clamp attachment 13 or clamp jaw 130. Thus, the present invention may include a kit with one or more of a bar clamp attachment 130, one or more of a bar clamp jaw 130, one or more of a bar clamp 9, 136, or any combination thereof.

The present invention may also include a method of adhering, gluing, welding, or otherwise bonding walls at an angle to each other. The method may include abutting ends of the walls against each other with the walls extending in respective planes at an obtuse angle relative to each other. The method may thus include engaging a first bonding edge of a first wall to a first bonding edge of the second wall and engaging a second clamping edge of the first wall with a first angled clamp jaw of the bar clamp. The method may also include engaging a second clamping edge of the second wall with a second jaw of the bar clamp and tightening the clamp to induce a snug fit between the walls.

If the walls to be bonded at an angle are made of wood, the method may include a preliminary step of placing glue on the bonding edges prior to tightening the clamp. Also, after inducing a snug fit, the method may include adjusting the walls with a hand mallet or other object to achieve a flush fit. The method may include tightening the clamp further and allowing the glue to dry as the walls are held in place by the clamp. Other types of walls and other types of bonding may be applied without departing from the spirit and scope of the invention. For example, if the walls are metal or other material that can be welded, they may be held in place by the clamp so that the user may weld the walls together. Apparatuses and methods in accordance with the present invention may also be applied to cement structures.

Accordingly, for the exemplary purposes of this disclosure, the components defining any embodiment of the invention may be formed as one piece or may be assembled from a plurality of pieces. Alternatively, an entire embodiment may be molded or cast in one single piece. The components may also be composed of any of many different types of materials or combinations thereof that can readily be formed into shaped objects provided that the components selected are consistent with the intended mechanical operation of the invention. For example, the components may be formed of composites such as fiberglass, carbon-fiber and/or other like materials, polymers such as plastic, polycarbonate, PVC plastic, ABS plastic, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

Alternate embodiments may include any of a variety of combinations of features from any of the embodiments described herein. For example, an embodiment of a clamp attachment could have a ring encircling the bar clamp bar as well as having a jaw receiving channel into which the first clamp jaw is inserted so that the attachment can only slide longitudinally along the bar clamp bar together with the first clamp jaw. Furthermore, it is to be understood that while the clamp attachments and angled clamping surfaces have been described primarily with regard to the first clamp jaw, the same or similar clamp attachments and angled clamping surfaces may be applied to the second clamp jaw without departing from the spirit and scope of the invention.

The components of the various embodiments described herein may be welded together or otherwise connected together. Alternate embodiments of the present invention may employ other methods of assembling and fusing the components together. Any method of attachment that allows the resultant structure to have the strength necessary for clamping walls together at obtuse angles is considered to be within the scope of the present invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A bar clamp attachment, comprising:

a jaw engaging piece, having a jaw engaging surface generally defining a plane, and a first clamping surface facing in a clamping direction opposite the jaw engaging surface; wherein:

the first clamping surface comprises at least two flat portions forming a channel having at least one line of intersection between the at least two flat portions;

the at least one line of intersection between the flat portions of the first clamping surface extends generally transversely to the clamping direction;

the bar clamp attachment further comprises an attachment mechanism connected to the jaw engaging surface;

the attachment mechanism comprises at least one end wall forming a positive stop for inhibiting movement of the clamp attachment away from a clamp jaw when supported thereon in a position of use;

the end wall is configured to abut and retain the clamp attachment against movement in a first stopping direction transverse to the clamping direction; and wherein at least one of the flat portions of the first clamping surface is disposed in a range from approximately five degrees to approximately eighty-five degrees relative to the jaw engaging surface.

2. The bar clamp attachment of claim 1, wherein at least one of the flat portions of the first clamping surface is disposed at substantially forty-five degrees relative to the jaw engaging surface.

3. The bar clamp attachment of claim 1, further comprising:

a base plate comprising the jaw engaging surface; and wherein the attachment mechanism comprises:

a jaw receiving channel on the jaw engaging surface, the jaw receiving channel having a depth and shape to receive a clamp jaw;

the jaw receiving channel including the end wall;

the jaw receiving channel including at least a side wall forming a positive stop in at least a second stopping direction, wherein the second direction is parallel to the first line of intersection.

4. The bar clamp attachment of claim 1, wherein the clamping surface is configured to be centered at a greater distance from the bar than at least one of the bar clamp jaws.

5. The bar clamp attachment of claim 1, wherein the bar clamp attachment is a single integrally molded or cast piece.

6. The bar clamp attachment of claim 1, further comprising a kit, wherein the bar clamp attachment is a first bar clamp attachment of a plurality of bar clamp attachments in the kit, wherein the plurality of bar clamp attachments are similar to the first bar clamp attachment.

7. The bar clamp attachment of claim 1, wherein the at least one line of intersection between the flat portions of the first clamping surface does not lie in the same plane as the longitudinal axis of the bar.

8. A bar clamp, comprising:

a bar supporting at least two jaw pieces;

at least a first of the jaw pieces having a first clamping surface facing in a first clamping direction parallel to a longitudinal axis of the bar; and at least a second of the jaw pieces having a second clamping surface facing in a second clamping direction opposite the first direction; wherein:

the first clamping surface comprises at least a first planar portion and a second planar portion, the first and second planar portions forming a channel;

at least a first line of intersection between the at least first and second planar portions of the first clamping surface;

the at least first line of intersection does not lie in the same plane as the longitudinal axis of the bar; and at least one of the planar portions of the first clamping surface is disposed in a range from approximately five degrees to approximately eighty-five degrees relative to the first clamping direction.

9. The bar clamp of claim 8, wherein at least one of the first and second planar portions is disposed at substantially forty-five degrees relative to the longitudinal axis of the bar.

10. The bar clamp of claim 8, wherein the first clamping surface further comprises:

a third planar portion of the first clamping surface; and a second line of intersection between the second and third planar portions of the first clamping surface;

the second line of intersection lying in the same plane as the first line.

11. The bar clamp of claim 8; wherein the planar portions of at least the first clamping surface intersect at right angles to each other.

12. The bar clamp of claim 8; wherein the planar portions of at least the first clamping surface intersect each other forming an angle less than one hundred eighty degrees.

13. The bar clamp of claim 8, wherein the first clamping surface is positioned at an angle by an angled gusset fused to both the clamp jaw and the channel.

14. The bar clamp of claim 8, wherein the flat portions of the clamping surface(s) are covered or coated with a non-abrasive material.

15. The bar clamp of claim 8, wherein the at least one clamp jaw is a single integrally molded or cast piece.

16. The bar clamp of claim 8, wherein:

the at least first clamping surface comprises a U-shaped channel for receiving a first wall oriented at an obtuse angle relative to an adjacent second wall to which the first wall is to be attached.

17. The bar clamp of claim 8, wherein:

the at least first clamping surface comprises an L-shaped channel for receiving a first wall oriented at an obtuse angle relative to an adjacent second wall to which the first wall is to be attached.

18. The bar clamp of claim 8, wherein the first clamping surface is centered at a greater distance from the bar than a center of at least one of the other clamping surfaces.

19. A bar clamp attachment, comprising:

a jaw engaging piece, having a jaw engaging surface generally defining a plane, and a first clamping surface facing in a clamping direction opposite the jaw engaging surface; wherein:

the first clamping surface comprises at least two flat portions forming a channel having at least one line of intersection between the at least two flat portions;

the at least one line of intersection between the flat portions of the first clamping surface extends generally transversely to the clamping direction;

the bar clamp attachment further comprises an attachment mechanism connected to the jaw engaging surface;

the attachment mechanism comprises at least one end wall forming a positive stop for inhibiting movement of the clamp attachment away from a clamp jaw when supported thereon in a position of use;

the end wall is configured to abut and retain the clamp attachment against movement in a first stopping direction transverse to the clamping direction; wherein:

the attachment mechanism further comprises a ring;

the ring lies generally in a same plane as the jaw engaging surface;

the plane of the ring extends transverse relative to the clamping direction; and the end wall is a section of an inner surface of the ring.

* * * * *